United States Patent [19]

Darrigo, Sr.

[11] Patent Number: 4,622,021

[45] Date of Patent: Nov. 11, 1986

[54] DOLL THAT GROWS

[76] Inventor: Joseph M. Darrigo, Sr., 27 Seneca St., Staten Island, N.Y. 10310

[21] Appl. No.: 790,979

[22] Filed: Oct. 24, 1985

[51] Int. Cl.[4] ..... A63H 3/36

[52] U.S. Cl. ..... 446/320

[58] Field of Search ..... 446/320, 390, 383

[56] References Cited

U.S. PATENT DOCUMENTS 268,020 11/1882 Howard ..... 446/320

2,623,329 12/1952 Di Leva ..... 446/320

FOREIGN PATENT DOCUMENTS 379561 3/1940 Italy ..... 446/320

*Primary Examiner*—Mickey Yu

*Attorney, Agent, or Firm*—Richard L. Miller

[57] ABSTRACT

A doll that grows is provided and has a device which has a thread portion in engagement with a thread hole for adjustably securing legs to the bottom of a torso of the main body portion of the doll for movement between a retracted portion and an extended position so as to simulate growth for the doll.

2 Claims, 4 Drawing Figures

DOLL THAT GROWS

BACKGROUND OF THE INVENTION

The instant invention relates generally to dolls and more specifically it relates to a doll that grows.

Numerous dolls have been provided in prior art that are adapted to be fabricated in various configurations. For example, U.S. Pat. Nos. 268,020: 1,828,765; 3,800,436 and 4,094,093 all are illustrative of such prior art. While these units may be suitable for the particular purpose to which they address, they would not be as suitable for the purposes of the present invention as heretofore described.

SUMMARY OF THE INVENTION

A principle object of the present invention is to provide a doll that grows which will overcome the shortcomings of the prior art devices.

Another object is to provide a doll that grows whereby the simulation of growth is created by the use of extensible legs from bottom of the torso of the doll.

An additional object is to provide a doll that grows wherein the legs retain the selected extended position they are normally placed into without sliding loosely out of that position.

A further object is to provide a doll that grows that is simple and easy to use.

A still further object is to provide a doll that grows that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
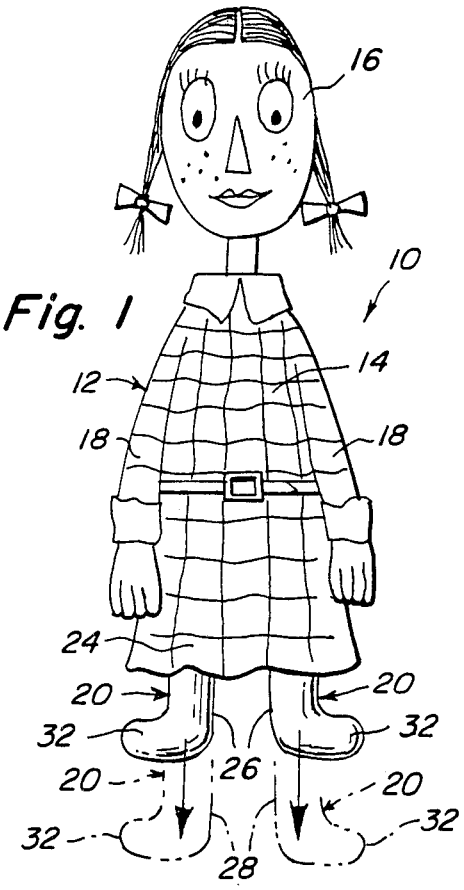
FIG. 1 is a front elevational view of a doll incorporating extendable legs.
Figure 2:
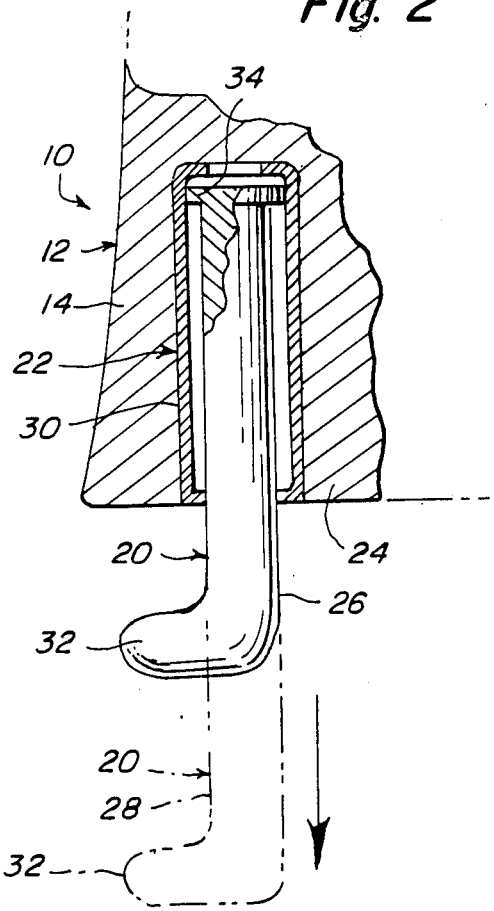
FIG. 2 is an enlarged cross sectional view taken in a same plane as FIG. 1, and showing the structure of a typical leg thereof.

Turning now descriptively to the drawings, in which similar reference characters denote similar elements throughout the several views, FIGS. 1 and 2 illustrate a doll 10 that grows. The doll contains a main body portion 12 being a torso 14, with a head 16 and a pair of arms 18 attached thereto. A pair of legs 20 are also provided with a device 22 for adjustably securing the legs 20 to bottom 24 of the torso 14 for movement between a retracted position 26 and an extended position 28 shown in phantom.

The adjustably securing device 22 includes a pair of receivers 30 mounted within the bottom 24 of the torso 14 of the main body portion 12. Each of the receivers 30 is for accepting and concealing a substantial length of one of the legs 20 to simulate growth for the doll 10 between the retracted position 26 and the extended position 28.

Each of the legs 20 terminate at its lower distal end in a foot 32 and at its upper proximal end in a flange 34. Each of the receivers 30 is constructed and sized to slidably receive and retain one of the legs 20 by snug fit but retaining the flange 32 of the leg 20 against complete removal from the bottom 24 of the torso 14 of the main body portion 12.

Figure 3:
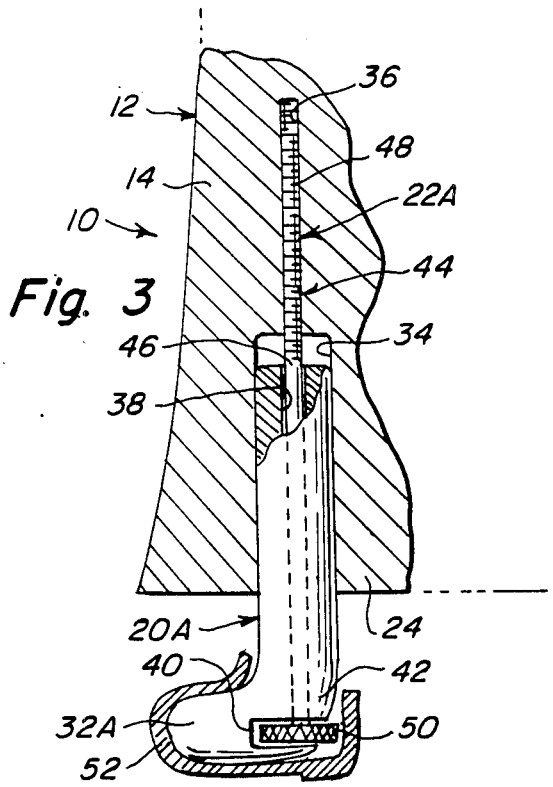
FIG. 3 is a view similar to FIG. 2, and showing a modified construction thereof wherein the leg retains the selected extended position, without sliding loosely.
Figure 4:
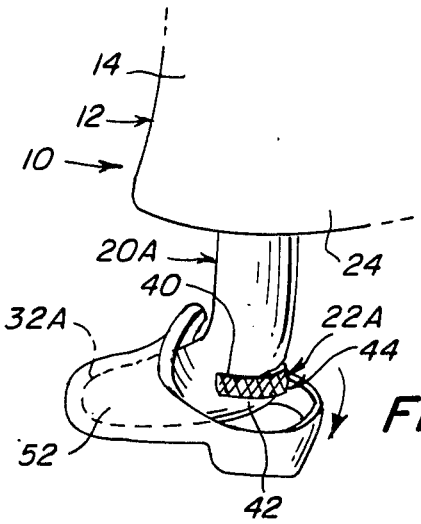
FIG. 4 shows a leg extension control thereof which is normally hidden by a shoe on the dolls foot.

FIGS. 3 and 4 show a different type of adjustably securing device 22A in which the bottom 24 of the torso 14 of the main body portion 12 has a pair of apertures 34. Each of the apertures 34 is for accepting and concealing a substantial length of one of the legs 20A to simulate growth for the doll 10 between the retracted position 26 and the extended position 28 as shown in FIG. 1.

Each of the apertures 34 has a threaded hole 36 in axial alignment. Each of the legs 20A terminates at its lower distal end in a foot 32A and has an axial bore 38 therethrough with a transverse slot 40 at heel portion 42 of the foot 32A.

A pair of leg extension controls 44 are provided. Each of the controls 44 is an elongated rod 46 that has a threaded portion 48 at its upper proximal end and a knurled head 50 at its lower distal end. The elongated rod 46 extends through the axial bore 38 with knurled head 50 in the transverse slot 40 and the threaded portion 48 in engagement with the threaded hole 36. The knurled head 50 can be turned for moving and retaining the leg 20A between the retracted position 26 and the extended position 28 without sliding loosely.

A pair of shoes 52 can also be utilized. Each shoe 52 is removably placed upon the foot 32A of each leg 20A for hiding the knurled head 50 of each of the leg extension controls 44 when the knurled head is not being turned.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A doll that grows which comprises:

(a) a main body portion being a torso with a head and a pair of arms attached thereto;

(b) a pair of legs; and (c) means for adjustably securing said legs to a bottom portion of said torso for movement between a retracted position and an extended position with respect to said torso, wherein said adjustably securing means includes said bottom portion of said torso of said main body portion having a pair of apertures, each of said apertures is for accepting and concealing a substantial length of each of said legs to simulate growth for said doll between said retracted position and said extended position, wherein said adjustably securing means further includes:

(i) each of said apertures having a threaded hole in axial alignment;

(ii) each of said legs terminating at its lower distal end in a foot and having an axial bore therethrough with a transverse slot at a heel portion of said foot; and (iii) a pair of leg extension controls, each of said controls being an elongated rod having a threaded portion at its upper proximal end and a knurled head at its lower distal end, said elongated rod extending through said axial bore with knurled head in said transverse slot and said threaded portion in engagement with said threaded hole so that said knurled head can be turned for moving and retaining said leg between said retracted position and said extended position without sliding loosely.

2. A doll that grows as recited in claim 1 further comprising a pair of shoes, each of said shoes removably placed upon said foot of each of said legs for hiding said knurled head of said leg extension controls when said knurled head is not being turned.

* * * * *